US010895825B2

(12) United States Patent
Hamada et al.

(10) Patent No.: US 10,895,825 B2
(45) Date of Patent: Jan. 19, 2021

(54) DEVELOPER ACCOMMODATING CONTAINER, DEVELOPING DEVICE AND PROCESS CARTRIDGE

(71) Applicant: CANON KABUSHIKI KAISHA, Tokyo (JP)

(72) Inventors: Takatoshi Hamada, Mishima (JP); Naoya Asanuma, Susono (JP); Yohei Kusano, Numazu (JP); Hideki Kakuta, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/357,659

(22) Filed: Mar. 19, 2019

(65) Prior Publication Data

US 2019/0302652 A1 Oct. 3, 2019

(30) Foreign Application Priority Data

Mar. 30, 2018 (JP) ..... 2018-066567

(51) Int. Cl.
*G03G 15/08* (2006.01)

(52) U.S. Cl.
CPC ..... *G03G 15/0889* (2013.01); *G03G 15/087* (2013.01); *G03G 2215/085* (2013.01); *G03G 2221/1657* (2013.01)

(58) Field of Classification Search
CPC ..... G03G 15/0822; G03G 15/0889; G03G 2215/0802; G03G 2215/085
See application file for complete search history.

(56) References Cited

U.S. PATENT DOCUMENTS 4,914,481 A 4/1990 Yoshikai
5,216,462 A 6/1993 Nakajima
(Continued)

FOREIGN PATENT DOCUMENTS

JP H08240973 A 9/1996
JP 2000181207 A 6/2000
(Continued)

OTHER PUBLICATIONS

Mori et al., JP 2015-087664 A, May 2015, JPO Computer Translation (Year: 2015).*
(Continued)

*Primary Examiner* — Erika J Villaluna
(74) *Attorney, Agent, or Firm* — Rossi, Kimms & McDowell LLP

(57) ABSTRACT

A developer accommodating container includes a developer accommodating portion, a stirring member, and a drive transmitting member. The developer accommodating container further includes an elastic member fixed to the stirring member at one end portion thereof and capable of expanding and contracting in a direction along a longitudinal direction of the developer accommodating portion. With respect to the longitudinal direction, the stirring member is disposed so as to form (1) a first gap between one end portion thereof and an inner surface of the developer accommodating portion on one side and (2) a second gap between the other end portion thereof and another inner surface of the developer accommodating portion on the other side. The stirring member is supported by the developer accommodating portion so as to be movable in the longitudinal direction relative to the developer accommodating portion.

10 Claims, 11 Drawing Sheets

(56) References Cited

U.S. PATENT DOCUMENTS

| | | | |
|---|---|---|---|
| 9,104,137 | B2 | 8/2015 | Murata et al. |
| 9,188,906 | B2 | 11/2015 | Batori et al. |
| 2009/0169241 | A1 | 7/2009 | Mimura |
| 2013/0136489 | A1 | 5/2013 | Yamaguchi |
| 2013/0164039 | A1 | 6/2013 | Matsushita |
| 2013/0308971 | A1 | 11/2013 | Kashiide |
| 2013/0308972 | A1 | 11/2013 | Shindo |
| 2013/0308979 | A1 | 11/2013 | Matsuzaki |
| 2013/0343785 | A1 | 12/2013 | Matsuzaki |
| 2014/0064793 | A1 | 3/2014 | Matsuzaki |
| 2014/0072330 | A1 | 3/2014 | Yoshida |
| 2014/0072345 | A1 | 3/2014 | Matsunaga |
| 2014/0072347 | A1 | 3/2014 | Furutani |
| 2014/0079432 | A1 | 3/2014 | Matsuzaki |
| 2014/0086620 | A1 | 3/2014 | Takeuchi |
| 2014/0086621 | A1 | 3/2014 | Makiguchi |
| 2014/0199092 | A1 | 7/2014 | Matsushita |
| 2015/0117904 | A1 | 4/2015 | Mori |
| 2016/0062270 | A1 | 3/2016 | Fukasawa |
| 2016/0282763 | A1 | 9/2016 | Maeshima |
| 2016/0282764 | A1 | 9/2016 | Gofuku |
| 2016/0349669 | A1 | 12/2016 | Oshima |
| 2017/0261886 | A1 | 9/2017 | Isobe |
| 2017/0285527 | A1 | 10/2017 | Okabe |
| 2018/0011426 | A1 | 1/2018 | Mizutani |
| 2018/0164714 | A1 | 6/2018 | Takahashi |
| 2019/0113865 | A1 | 4/2019 | Matsuzaki |

FOREIGN PATENT DOCUMENTS

| | | | | |
|---|---|---|---|---|
| JP | 2004205758 | A | | 7/2004 |
| JP | 2013076755 | A | | 4/2013 |
| JP | 2014112206 | A | | 6/2014 |
| JP | 2014149412 | A | | 8/2014 |
| JP | 2015087664 | A | * | 5/2015 |

OTHER PUBLICATIONS

Copending U.S. Appl. No. 16/357,412, filed Mar. 19, 2019 (a copy is not included because the cited application is not yet available to the public and the Examiner has ready access to the cited application).

Notice of Allowance issued in U.S. Appl. No. 16/357,412 dated Jan. 23, 2020.

* cited by examiner

DEVELOPER ACCOMMODATING CONTAINER, DEVELOPING DEVICE AND PROCESS CARTRIDGE

FIELD OF THE INVENTION AND RELATED ART

The present invention relates to a developer accommodating chamber provided in an electrophotographic image forming apparatus such as a copying machine or a printer and relates to a developing device and a process cartridge which includes the developer accommodating chamber.

The electrophotographic image forming apparatus forms an image on a recording material (recording medium) by using an electrophotographic image forming type. Examples of the image forming apparatus include a copying machine, a printer (laser beam printer, LED printer or the like), a facsimile machine, a word processor, a multi-function machine (multi-function printer), and the like.

In the image forming apparatus such as the printer using the electrophotographic image forming type (electrophotographic process), an electrophotographic as an image bearing member (hereinafter, referred to as a photosensitive drum) is electrically charged uniformly. Then, the charged photosensitive drum is selectively exposed to light, so that an electrostatic image is formed on a surface of the photosensitive drum. Then, the electrostatic image on the photosensitive drum is visualized as a toner image with toner as a developer. Then, the toner image formed on the surface of the photosensitive drum is transferred onto a recording material such as a recording sheet or a plastic sheet. Further, the toner image transferred on the recording material is fixed on the recording material under application of heat and pressure, so that image recording is carried out.

In such an image forming apparatus, in general, maintenance of various process means is needed. In order to facilitate the maintenance of the various process means, a process cartridge which is prepared by integrally assembling the photosensitive drum as described above and process means such as a charging means, a developing means, a cleaning means and the like into a cartridge (unit) in a frame and which is made mountable in (attachable to) and dismountable (detachable) from an image forming apparatus main assembly has been put into practical use. According to a process cartridge type, it is possible to provide an image forming apparatus excellent in usability.

The developing device generally includes a developer carrying member for supplying a developer to the photosensitive drum, a developing portion in which a developer supplying member for supplying the developer to the developer carrying member, and a developer accommodating chamber for accommodating the developer to be supplied to the developing portion. Here, feeding of the developer from the developer accommodating chamber toward the developing portion is performed using a rotatable stirring member in general.

In such a constitution, the developer localizes and agglomerates in the developer accommodating chamber during transportation or the like in some instances. In a state in which the developer agglomerates, there is a liability that a rotational load of a stirring member extremely increases.

Therefore, in Japanese Laid-Open Patent Application (JP-A) Hei 8-240973, a constitution in which separately from the stirring member, a swingable plate and a spring are provided on an inner wall of a toner container, and the developer is swung by swinging the swingable plate by vibration during the transportation or the like, so that agglomeration of the developer is suppressed is disclosed.

Further, in JP-A 2000-181207, a constitution in which a stirring member and a driving member for driving the stirring member are provided and in which not only the stirring member is made movable in one direction on a side where the stirring member is spaced from the driving member in a rotational axis direction of the stirring member but also the stirring member is urged in a direction in which the stirring member approaches the driving member is disclosed. In this constitution, when the stirring member is driven in a state in which a rotational load is large, the stirring member swings with respect to a rotational axis direction without rotating and loosens the agglomerated developer, so that when the developer is loosened and the rotational load is decreased, the stirring member rotates.

However, in JP-A Hei 8-240973 and JP-A 2000-181207, a constitution in which the agglomeration of the developer generating during the transportation can be effectively suppressed by a simple structure without adding a swingable separate member has not yet been sufficiently studied.

SUMMARY OF THE INVENTION

A principal object of the present invention is to provide a developer accommodating chamber capable of effectively suppressing agglomeration of a developer generating during transportation.

Another object of the present invention is to provide a developing device and a process cartridge which include the developer accommodating chamber.

According to an aspect of the present invention, there is provided a developer accommodating container comprising: a developer accommodating portion configured to accommodate a developer; a stirring member rotatably provided in the developer accommodating portion and configured to stir the developer accommodated in the developer accommodating portion, the stirring member extending in a longitudinal direction of the developer accommodating portion; and a drive transmitting member configured to transmit a rotational driving force to the stirring member, wherein the developer accommodating container further comprises an elastic member, which is fixed to the stirring member at one end portion thereof and to the drive transmitting member at the other end portion thereof, and which is capable of expanding and contracting in a direction along a longitudinal direction of the developer accommodating portion, and wherein the stirring member is disposed so as to form (1) a first gap between one end portion thereof and an inner surface of the developer accommodating portion on one side with respect to the longitudinal direction and (2) a second gap between the other end portion thereof and another inner surface of the developer accommodating portion on the other side with respect to the longitudinal direction, and wherein the stirring member is supported by the developer accommodating portion so as to be movable in the longitudinal direction relative to the developer accommodating portion.

Further features of the present invention will become apparent from the following description of exemplary embodiments with reference to the attached drawings.

BRIEF DESCRIPTION OF THE DRAWINGS

Parts (a), (b) and (c) of FIG. 1 are sectional views showing a structure of a developer accommodating chamber according to Embodiment 1.

Figure 7:
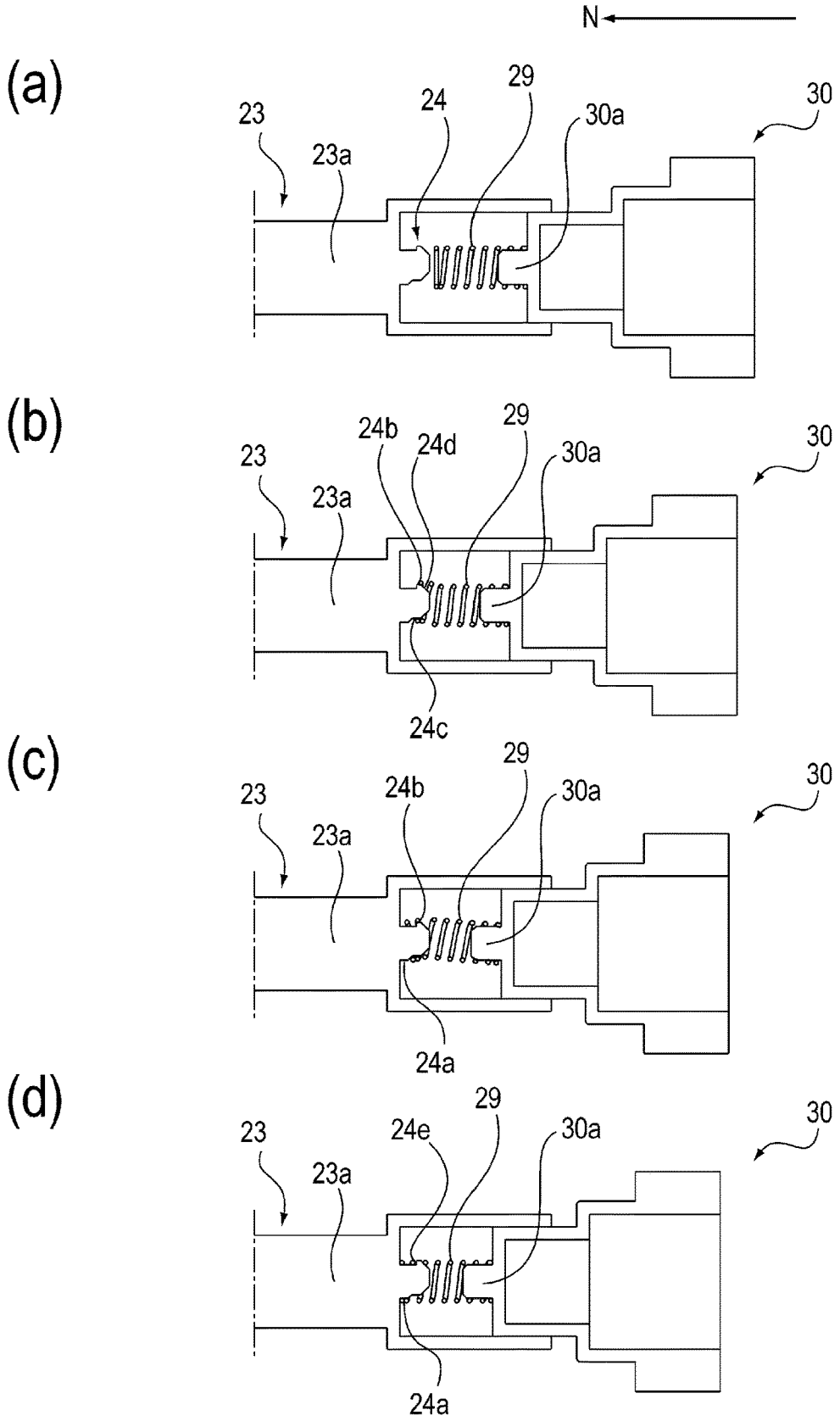

Parts (a) to (d) of FIG. 7 are schematic views showing an assembling method of an elastic member into the stirring member in another example of Embodiment 1.

Figure 8:
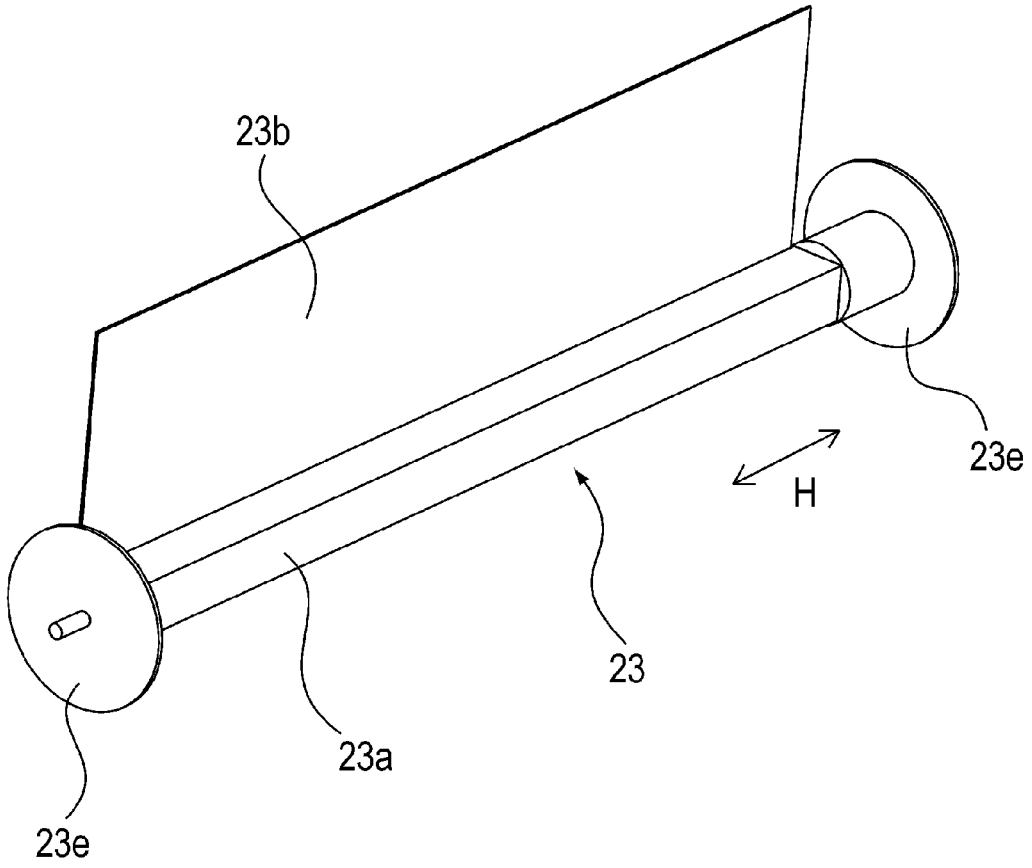

FIG. 8 is a perspective view showing a structure of a stirring member in Embodiment 2.

Figure 9:
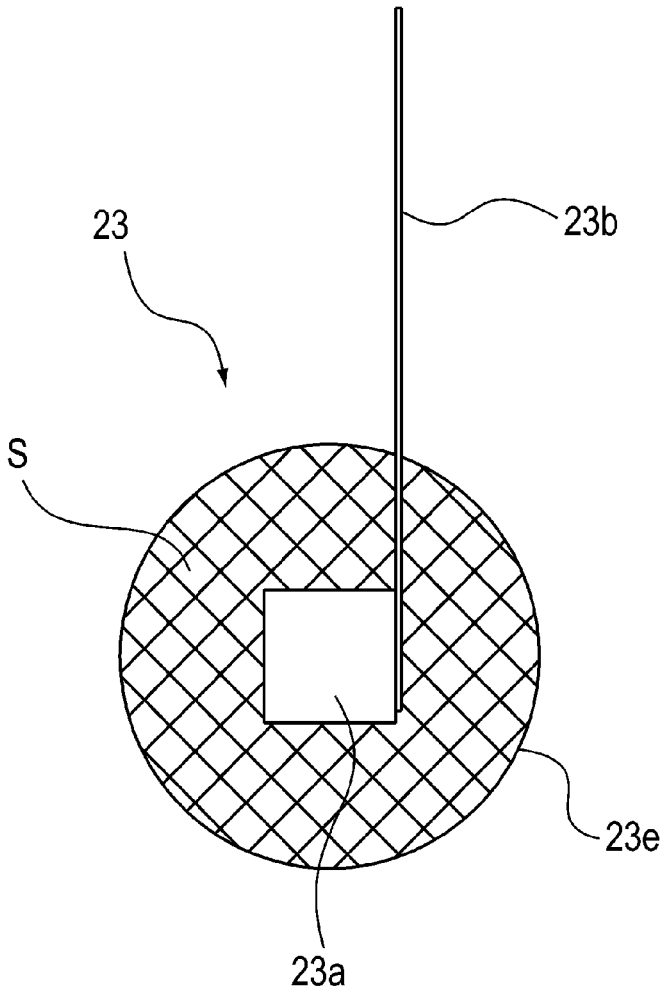

FIG. 9 is a projected view of the stirring member in Embodiment 2.

Figure 10:
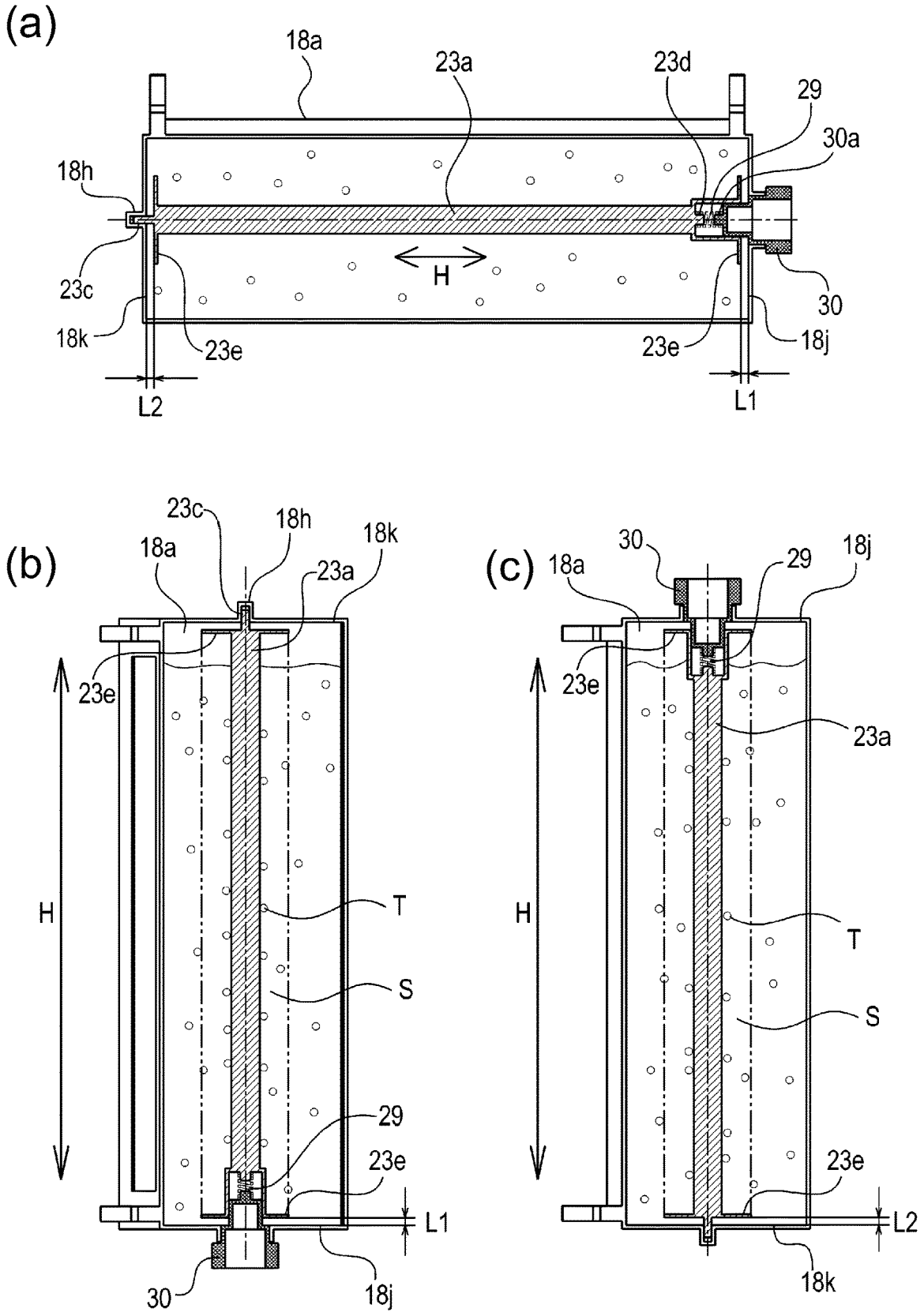

Parts (a), (b) and (c) of FIG. 10 are schematic views for comparing a difference in state between during transportation and during image formation in Embodiment 2.

Figure 11:
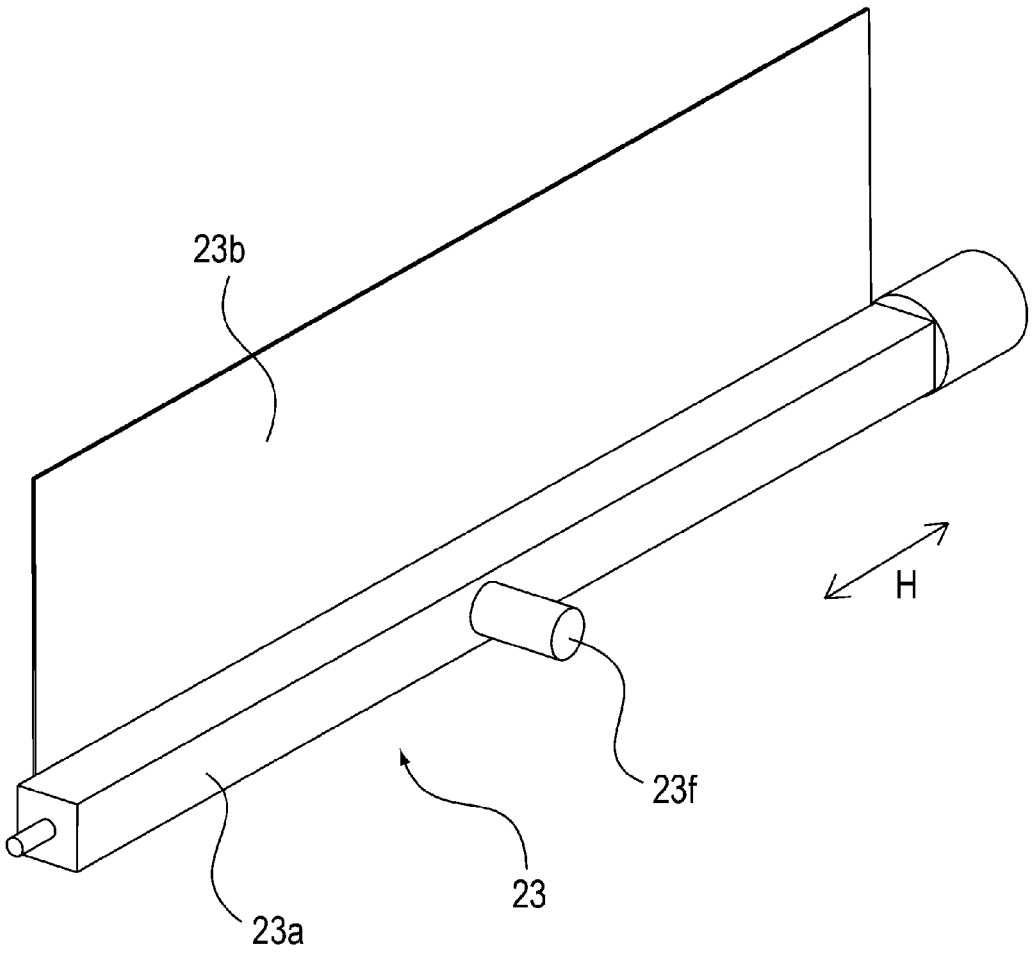

FIG. 11 is a perspective view showing a stirring member in another example of Embodiment 2.

DESCRIPTION OF EMBODIMENTS

Embodiments of the present invention will be specifically described with reference to the drawings. However, dimensions, materials, shapes and relative arrangements of constituent elements described in the following embodiments should be appropriately be changed depending on structures and various conditions of apparatuses to which the present invention is applied, and the scope of the present invention is not intended to be limited to the following embodiments, unless otherwise specified.

[Electrophotographic Image Forming Apparatus]

Figure 2:
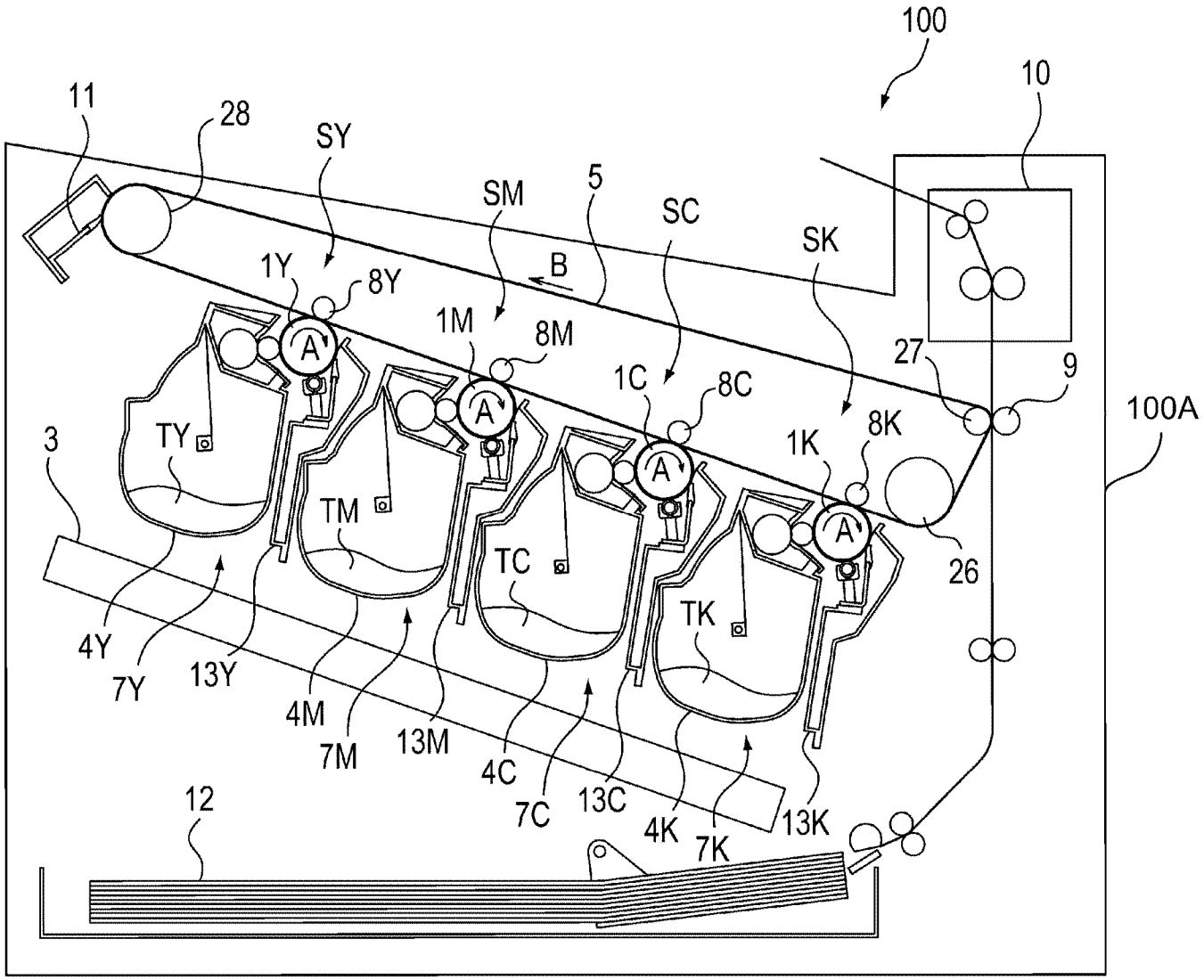
FIG. 2 is a schematic sectional view of an electrophotographic image forming apparatus and process cartridges in Embodiment 1.
Figure 3:
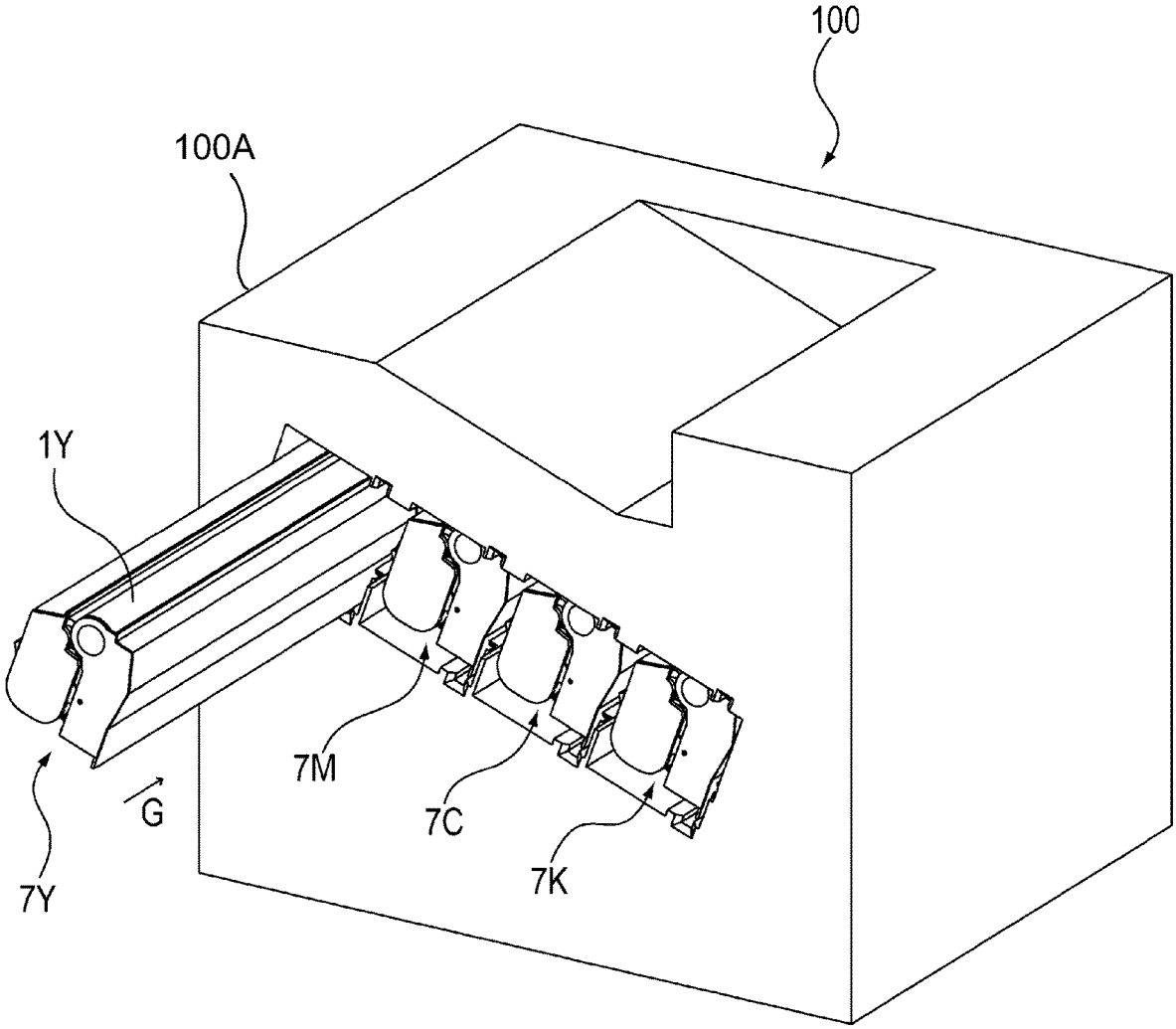
FIG. 3 is a perspective view of the electrophotographic image forming apparatus and the process cartridges in Embodiment 1.
Figure 4:
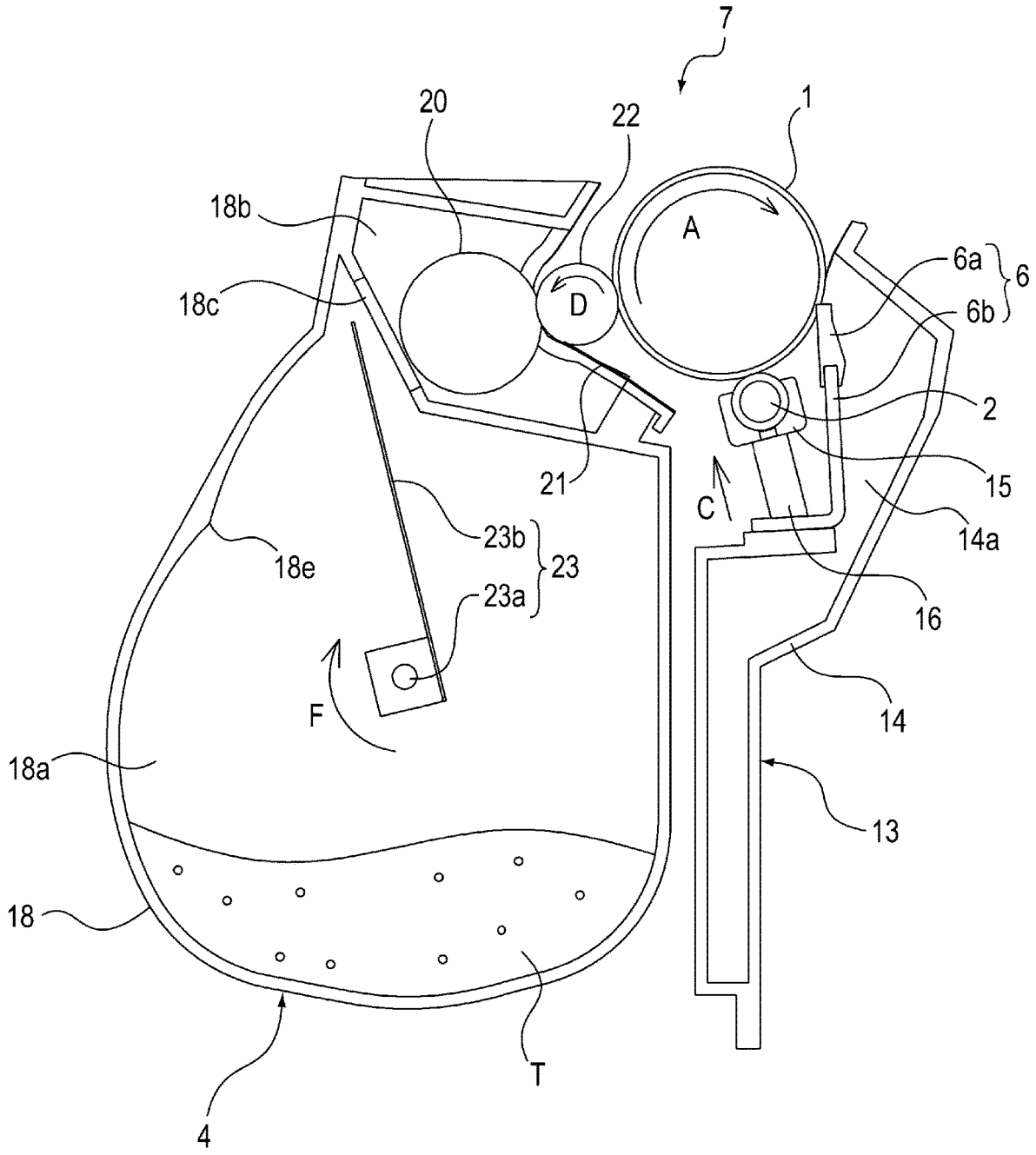
FIG. 4 is a sectional view of the process cartridge in Embodiment 1.

First, a general structure of an electrophotographic image forming apparatus will be described using FIGS. 2, 3 and 4. FIG. 2 is a schematic sectional view of an image forming apparatus 100. FIG. 3 is a perspective view showing a state in which a process cartridge 7 is being mounted into (attached to) the image forming apparatus 100. FIG. 4 is a schematic sectional view of the process cartridge 7.

The image forming apparatus 100 includes, as a plurality of image forming portions, first, second, third and fourth image forming portions SY, SM, SC and SK for forming images of colors of yellow (Y), magenta (M), cyan (C) and black (K), respectively. In this embodiment, structures and operations of the first to fourth image forming portions SY, SM, SC and SK are substantially the same except that the colors of the images formed are different from each other. Accordingly, in the case where particular distinction is not required, constituent elements will be collectively described by omitting Y, M, C and K.

That is, in this embodiment, the image forming apparatus 100 includes four electrophotographic photosensitive drums 1 (1Y, 1M, 1C and 1K) as image bearing members for bearing developer images. Each of the photosensitive drums 1 rotates in an arrow A direction in FIG. 4. Around each of the photosensitive drums 1, a charging roller 2 and a scanner unit (exposure device) 3 are provided.

Here, the charging roller 2 is a charging means for electrically charging a surface of the photosensitive drum 1 uniformly. The scanner unit 3 is an exposure means for forming an electrostatic (latent) image on the photosensitive drum 1 by irradiating the charged surface of the photosensitive drum 1 with laser light on the basis of image information.

Further, around the photosensitive drums 1, developing devices (developing units) 4 (4Y, 4M, 4C and 4K) and cleaning blades 6 (6Y, 6M, 6C and 6K) as cleaning means are provided, respectively.

An intermediary transfer belt 5 as an intermediary transfer member for transferring toner images from the photosensitive drums 1 onto a recording material 12 is provided opposed to the respective photosensitive drums 1.

In this embodiment, the developing units 4Y, 4M, 4C and 4K use, as developers, non-magnetic monocomponent developers, i.e., toners T (TY, TM, TC and TK). In this embodiment, the developing unit 4 causes a developing roller 22 as a developer carrying member for carrying the developer to contact the photosensitive drum 1, so that contact development is carried out.

In this embodiment, a photosensitive member unit 13 including the photosensitive drum 1, the charging roller 2, the cleaning blade 6 and a removed developer accommodating portion for accommodating a transfer residual toner (waste toner) remaining on the photosensitive drum 1 (hereinafter, referred to as a residual toner accommodating portion 14*a* (14*a*Y, 14*a*M, 14*a*C and 14*a*K).

Further, in this embodiment, the process cartridge 7 (7Y, 7M, 7C and 7K) is formed by integrally assembling the developing unit 4 as a DAC (4) and the photosensitive member unit 13 into a cartridge.

The process cartridge 7 is dismountably mounted in (detachably attached to) the image forming apparatus 100 (apparatus main assembly 100A) via an unshown mounting guide 36 provided in the image forming apparatus 100 and an unshown positioning member and receives a driving force from the image forming apparatus 100.

In this embodiment, the process cartridge 7 is mountable in (attachable to) and dismountable (detachable) from the apparatus main assembly 100A of the image forming apparatus 100 along an axial direction of the photosensitive drum 1 as shown by an arrow G in FIG. 3. In this embodiment, the respective process cartridges 7 for the respective colors have the same shape. In the process cartridges 7 for the colors, the toners T (TY, TM, TC and TK) of the colors of yellow (Y), magenta (M), cyan (C) and black (K) are accommodated, respectively.

The intermediary transfer belt 5 contacts all the photosensitive drums 1 and rotates in an arrow B direction in FIG. 2. The intermediary transfer belt 5 is extended and stretched around a plurality of supporting members (a driving roller 26, a secondary transfer opposite roller 27, a follower roller 28).

On an inner peripheral surface side of the intermediary transfer belt 5, as primary transfer means, four primary transfer rollers 8 (8Y, 8M, 8C and 8K) are juxtaposed so as to oppose the associated photosensitive drums 1, respectively. Further, on an outer peripheral surface side of the intermediary transfer belt 5, at a position opposing the secondary transfer opposite roller 27, a secondary transfer roller 9 as a secondary transfer means is provided.

[Image Forming Process]

During image formation, first, the surface of the photosensitive drum 1 is electrically charged uniformly by the charging roller 2. Then, by the laser light emitted from the scanner unit 3 depending on image information, the charged surface of the photosensitive drum 1 is subjected to scanning exposure, so that the electrostatic latent image depending on the image information is formed on the surface of the photosensitive drum 1. Then, the electrostatic latent image formed on the photosensitive drum 1 is developed as the toner image by the developing unit 4. The toner image formed on the photosensitive drum 1 is transferred (primary-transferred) onto the intermediary transfer belt 5 by the action of the primary transfer roller 8.

For example, during full-color image formation, the above-described image forming process is successively performed at the image forming portions SY, SM, SC and SK, so that the toner images for the respective colors formed on the surfaces of the photosensitive drums 1 are successively primary-transferred superposedly onto the intermediary transfer belt 5.

Thereafter, the recording material 12 is fed toward the secondary transfer portion N in synchronism with movement of the intermediary transfer belt 5. The four color toner images the intermediary transfer belt 5 by the action of the secondary transfer roller 9 contacting the recording material 12 carried on the intermediary transfer belt 5 are secondary-transferred collectively onto the recording material 12.

The recording material 12 on which the toner images are transferred is fed to the fixing device 10 as the fixing means. In the fixing device 10, heat and pressure are applied to the recording material 12, so that the toner images are heat-fixed on the recording material 12.

The primary transfer residual toner remaining on the surface of each of the photosensitive drums 1 after the primary transfer step is removed by the cleaning blade 6. Further, the secondary transfer residual toner remaining on the outer peripheral surface of the intermediary transfer belt 5 after the secondary transfer step is removed by an intermediary transfer belt cleaning device 11.

The removed transfer residual toner (waste toner) is discharged into an unshown residual (waste) toner box in the image forming apparatus 100.

The image forming apparatus 100 can be also form a monochromatic (single-color) or multi-color image by using only the image forming portion(s) for a desired single color or the desired some colors (not all the colors).

[Process Cartridge]

Next, a general structure of the process cartridge 7 mounted in the image forming apparatus 100 will be described using FIG. 4. FIG. 4 is a schematic sectional view of the process cartridge 7.

The photosensitive member unit 13 includes the cleaning frame 14 as a frame for supporting various elements in the photosensitive member unit 13. The cleaning frame 14, the photosensitive drum 1 is mounted rotatably in the arrow A direction via a bearing member.

The cleaning frame 14 further includes a charging roller bearing 15 provided along a line passing through a rotation center of the charging roller 2 and a rotation center of the photosensitive drum 1. Here, the charging roller bearing 15 is mounted movably in an arrow C direction. The charging roller 2 is mounted rotatably in the charging roller bearing 15. Further, the charging roller bearing 15 is urged toward the photosensitive drum 1 by a charging roller urging spring 16 as an urging means.

Further, the cleaning blade 6 is prepared by integrally assembling an elastic member 6*a* for removing the transfer residual toner (waste toner) remaining on the photosensitive drum 1 after the primary transfer and a supporting member 6*b* for supporting the elastic member 6*a*.

The residual (waste) toner removed from the surface of the photosensitive drum 1 by the cleaning blade 6 drops in a direction of gravitation in a space formed by the cleaning blade 6 and the cleaning frame 14, and is accommodated in the residual toner accommodating portion 14*a*.

The developing unit 4 includes a developing (device) frame 18 as a frame for supporting various elements in the developing unit 4. The developing unit 4 is provided with the developing roller 22 as the developer carrying member rotating in an arrow D direction in contact with the surface of the photosensitive drum 1. The developing roller 22 is rotatably supported via bearings by the developing frame 18, at both end portions thereof with respect to a longitudinal direction (rotational axis direction).

The developing unit 4 includes a developer accommodating portion 18*a* for accommodating the toner T (developer), a developing chamber 18*b* provided with the developing roller 22, and an opening 18*c* for permitting communication between the developer accommodating portion 18*a* and the developing chamber 18*b*. In this embodiment, the developing chamber 18*b* is positioned above the developer accommodating portion 18*a*.

In the developing chamber 18*b*, a toner supplying roller 20 as a toner supplying member rotating in contact with the developing roller 22 and a developing blade 21 as a developer regulating member for regulating a toner layer on the developing roller 22 are provided.

Further, in the developer accommodating portion 18*a* of the developing frame 18, a stirring member 23 for feeding the toner to the toner supplying roller 20 through an opening 18*c* is provided. The stirring member 23 includes a rotation shaft 23*a* as a shaft portion parallel to a rotational axis direction of the developing roller 22 and a stirring sheet 23*b*, as a stirring portion which is a flexible sheet member, for stirring and feeding the toner.

The stirring sheet 23*b* rotates (in an arrow F direction) in a state in which the stirring sheet 23*b* contacts an inner wall surface of the developer accommodating portion 18*a* and is flexed. The developer accommodating portion 18 has a releasing position 18*e* where the stirring sheet 23*b* is released from the flexed state. When the stirring sheet 23*b* passes through the releasing position 18*e*, by a force for releasing the stirring sheet 23*b* from the flexed state, the toner T on the stirring sheet 23*b* is leaped upward, so that the toner T is fed toward the toner supplying roller 20 in the developing chamber 18*b* through the opening 18*c*.

[Structure of Developer Accommodating Portion]

Figure 1:
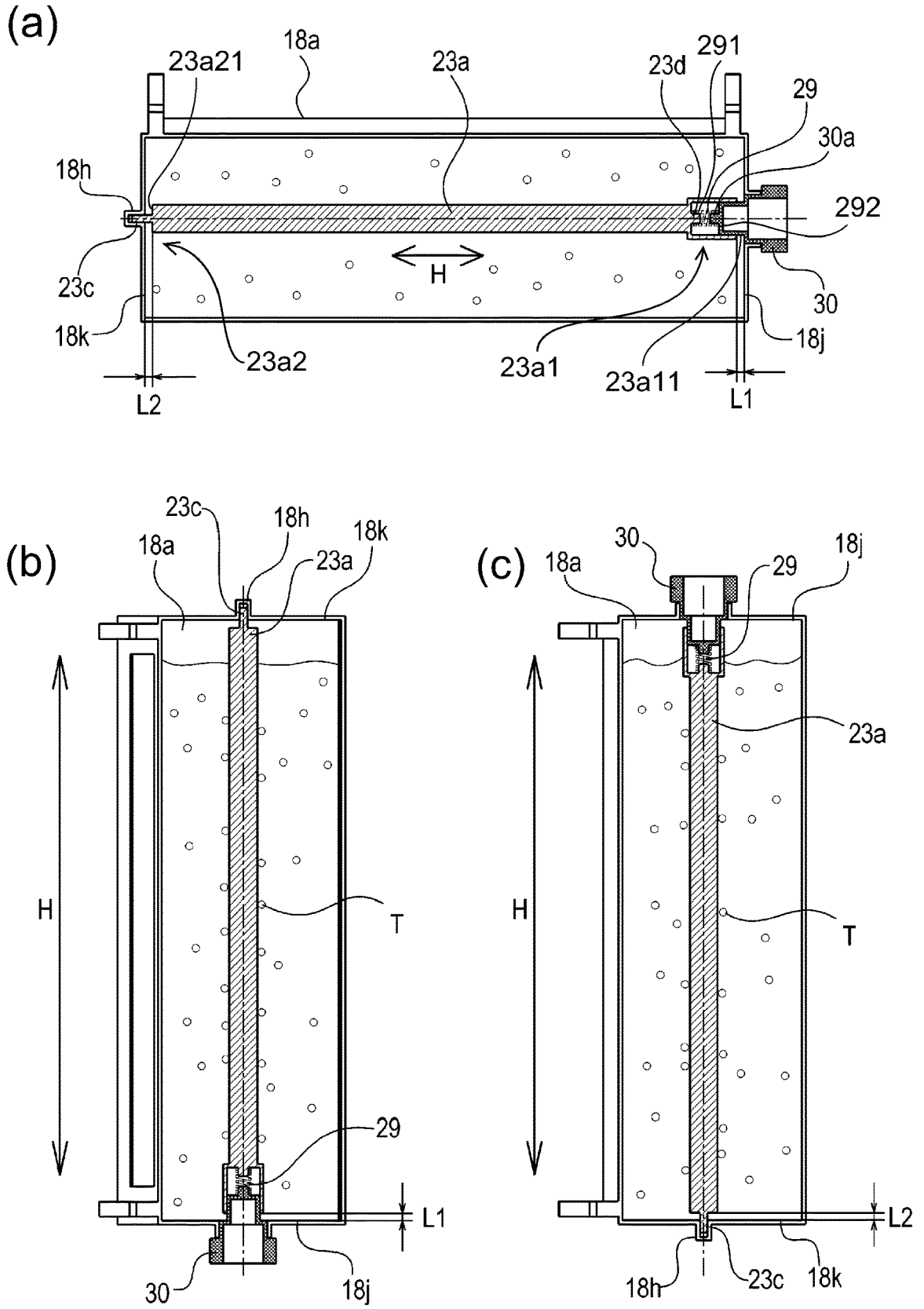
Figure 5:
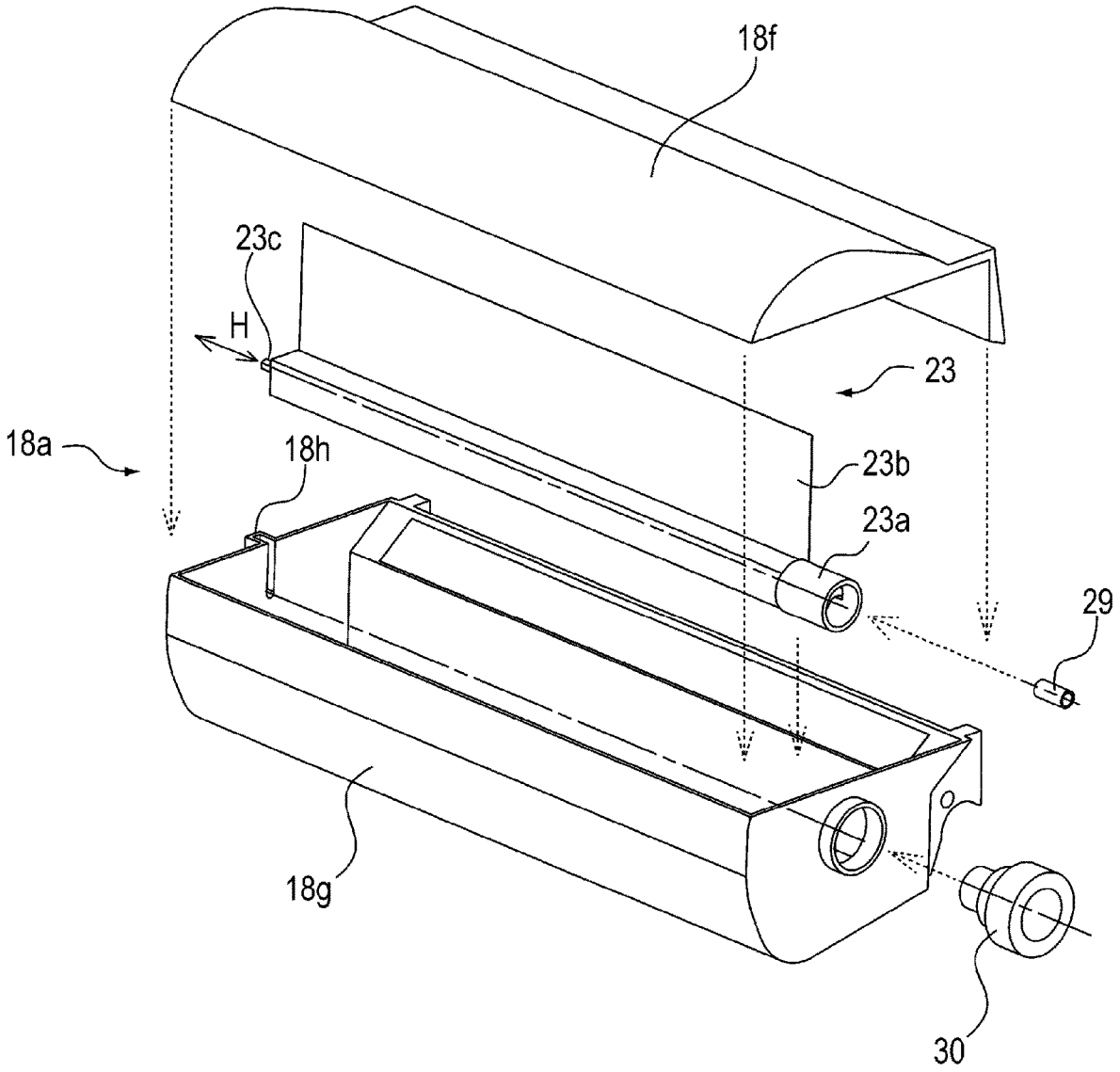
FIG. 5 is a perspective view showing a structure of the developer accommodating chamber in Embodiment 1.

A structure of the developer container 38 will be described using part (a) of FIG. 1 and FIG. 5. Part (a) of FIG. 1 is a sectional view showing the structure of the developer accommodating portion 18*a*. FIG. 5 is a perspective view showing the structure of the developer accommodating portion 18*a*.

As shown in FIG. 5, an outer casing constituting the developer accommodating portion 18*a* is formed by integrally assembling both an upper frame 18*f* and a lower frame 18*g* into a unit.

As described above, in the developer accommodating portion 18*a*, the stirring member 23 for stirring the toner T accommodated in the developer accommodating portion 18*a* is disposed. The stirring member 23 is disposed so that one end portion 23*a*1 of the rotation shaft 23*a* with respect to an axial direction H is connectable with a drive transmitting member (gear) 30. Here, the rotation shaft 23*a* extends in a longitudinal direction of the developer accommodating portion 18*a*, and the axial direction H of the rotation shaft 23*a* and the longitudinal direction of the developer accommodating portion 18*a* substantially coincide with each other.

First, as regards the stirring member 23, an elastic member 29 is mounted in the one end portion 23*a*1 (on the drive transmitting member 30 side) of the rotation shaft 23*a* with respect to the axial direction H. Specifically, as shown in part (a) of FIG. 1, in the one end portion 23*a*1 of the rotation shaft 23*a*, a projected portion 23*d* on which one end portion 291 of the elastic member 29 is to be mounted is provided. The one end portion 291 of the elastic member 29 is press-fitted around the projected portion 23*d* provided at the end portion 23*a*1 of the rotation shaft 23*a*, so that the elastic member 29 is fixed to the stirring member 23. As a result, the stirring member 23 and the elastic member 29 are combined with each other.

Next, the stirring member 23 including the elastic member 29 is disposed inside the lower frame 18*g* constituting the developer accommodating portion 18*a*. At this time, the stirring member 23 is disposed so that the other end portion 23*a*2 (portion to be supported 23*c*) thereof is supported by a supporting portion 18*h* provided on an inside surface 18*k* of the developer accommodating portion 18*a* on the other side. Then, from an outside of the developer accommodating portion 18*a*, the drive transmitting member (gear) 30 (rotational driving portion) for transmitting a rotational driving force to the stirring member 23 is inserted, and is connected with the one end portion 23*a*1 of the stirring member 23. At this time, the stirring member 23 and the drive transmitting member 30 engage with each other, so that the stirring member 23 is rotatable with rotation of the drive transmitting member 30. A state of engagement between the stirring member 23 and the drive transmitting member 30 will be described later.

Further, as shown in part (a) of FIG. 1, the drive transmitting member 30 is provided with a projected portion 30*a* on which the elastic member 29 is to be mounted. The other end portion 292 of the elastic member 29 is press-fitted around the projected portion 30*a* of the drive transmitting member 30, so that the elastic member 29 is fixed to the drive transmitting member 30. As a result, the drive transmitting member 23 and the elastic member 29 are combined with each other.

Thus, the stirring member 23, the elastic member 29 and the drive transmitting member 30 are integrally assembled and are supported by the developer accommodating portion 18*a*.

Further, the stirring member 23 supported by the developer accommodating portion 18*a* is disposed so that a gap (clearance) L1 is formed between the one end portion 23*a*1 (end surface 23*a*11) of the rotation shaft 23*a* and an inside surface 18*j* of the developer accommodating portion 18*a* on the one side 8 the drive transmitting member 30 side). Further, the stirring member 23 is disposed so that a gap L2 is formed between the other end portion 23*a*2 (end surface 23*a*21) of the rotation shaft 23*a* and the inside surface 18*k* of the developer accommodating portion 18*a* on the other side (side opposite from the drive transmitting member 30). Further, as described above, the stirring member 23 is disposed so that one end portion thereof is supported by the drive transmitting member 30 inserted from the outside of the developer accommodating portion 18*a* on one side and the other end portion 23*a*2 (portion-to-be-supported 23*c*) is supported by the supporting portion 18*h* of the developer accommodating portion 18*a* on the other side.

Thus, the stirring member 23 is supported by the developer accommodating portion 18*a* so that the stirring member 23 is movable in the longitudinal direction (axial direction H) of the developer accommodating portion 18*a* relative to the developer accommodating portion 18*a*. Accordingly, the stirring member 23 can be moved in the axial direction H of the rotation shaft 23*a* depending on an elastic force receiving from the elastic member 29.

Then, the upper frame 18*f* and the lower frame 18*g* are bonded to each other, and the toner T is charged (filled) into the developer accommodating portion 18*a* through a toner charging (filling) opening (not shown).

As shown in part (a) of FIG. 1, in a state in which the developer accommodating portion 18*a* is completed (in an attitude other than a vertically placed attitude (state) in which a rotational axis of the stirring member extends in a direction of gravitation), the elastic member 29 is disposed in a free length, so that not only a compression force but also a tensile force do not act on the elastic member 29. The elastic member 29 is a compression spring capable of expanding and contracting in the longitudinal direction (axial direction H) of the developer accommodating portion 18*a*, and by the free length of this compression spring, a longitudinal position of the developer accommodating portion 18*a* by which the stirring member 23 is supported is determined.

[During Transportation]

Subsequently, a state of the process cartridge 7 during transportation will be described using parts (b) and (c) of FIG. 1. Parts (b) and (c) of FIG. 1 are sectional views showing a structure of the developer accommodating portion 18*a*.

As shown in parts (b) and (c) of FIG. 1, a situation in which the process cartridge 7 is transported in a vertically placed state such that an axis (a chain line in the figures) of the rotation shaft 23*a* of the stirring member 23 of the process cartridge 7 extends in the direction of gravitation will be described. Incidentally, for easy understanding of motion of component parts in this situation, herein, only associated component parts consisting of the developer accommodating portion 18*a*, the rotation shaft 23*a*, the elastic member 29 and the drive transmitting member 30 will be illustrated and described.

Part (b) of FIG. 1 shows a state of the developer accommodating portion 18*a* in the case where the process cartridge is transported with the drive transmitting member 30 facing downward with respect to the direction of gravitation.

As described above, the rotation shaft 23*a* is movable (swingable) in the axial direction H thereof depending on compression and tension of the elastic member 29. First, by transportation of the process cartridge 7, vibration is transmitted to the developer accommodating portion 18*a* in the same direction as the axial direction H of the rotation shaft 23*a*. Then, the elastic member 29 is compressed by a weight of the rotation shaft 23*a* and a weight of the toner T deposited on the rotation shaft 23*a*. By compression of the elastic member 29, the rotation shaft 23*a* moves in a direction approaching the inside surface 18*j*2 on one end side (the drive transmitting member 30 side) of the developer accommodating portion 18*a*. At this time, the gap L1 becomes small.

Thereafter, the compressed state of the elastic member 29 is restored to the original state, whereby the rotation shaft 23*a* moves in a direction in which the rotation shaft 23*a* is spaced from the inside surface 18*j*2 on one end side (the drive transmitting member 30 side) of the developer accommodating portion 18*a*. At this time, the gap L1 extends in a direction in which the state of the elastic member 29 returns to the original state. As long as the vibration during the transportation of the process cartridge 7 is continued, the rotation shaft 23*a* repeats a swing such that the rotation shaft 23*a* reciprocates in the axial direction H of the rotation shaft 23*a*.

When the rotation shaft 23*a* performs reciprocating swing thereof in the axial direction H, the toner contacting the rotation shaft 23*a* and the toner T around the rotation shaft 23*a* perform reciprocating swing in the axial direction H depending on motion of the stirring member 23.

Accordingly, the toner T does not readily gather closely on one end side (the drive transmitting member 30 side) of a side surface of the developer accommodating portion 18*a*, so that agglomeration of the toner T due to localization of the toner T can be suppressed.

Part (c) of FIG. 1 shows a state of the developer accommodating portion 18*a* in the case where the developer container 7 is transported with the drive transmitting member 30 facing upward with respect to the direction of gravitation. First, by transportation of the process cartridge 7, vibration is transmitted to the developer accommodating portion 18*a* in the same direction as the axial direction H. Then, the elastic member 29 is stretched by, a weight of the rotation shaft 23*a* and a weight of the toner T deposited on the rotation shaft 23*a*. By stretch of the elastic member 29, the rotation shaft 23*a* moves in a direction of approaching the inside surface 18*k* of the developer accommodating portion 18*a* on the other end side (opposite from the drive transmitting member 30 side). At this time, the gap L2 becomes small. Thereafter, the stretched state of the elastic member 29 is restored to the original state, whereby the rotation shaft 23*a* moves in a direction in which the rotation shaft 23*a* is spaced from the inside surface 18*k* of the developer accommodating portion 18*a* on the other end side (opposite from the drive transmitting member 30 side). At this time, the gap L2 extends in a direction in which the state of the elastic member 29 returns to the original state. As long as the vibration during the transportation of the process cartridge 7 is continued, the rotation shaft 23*a* repeats a swing such that the rotation shaft 23*a* reciprocates in the axial direction H. When the rotation shaft 23*a* performs reciprocating swing thereof in the axial direction H, the toner contacting the rotation shaft 23*a* and the toner T around the rotation shaft 23*a* perform reciprocating swing in the axial direction H depending on motion of the stirring member 23. Accordingly, the toner T does not readily gather closely on the other end side (opposite from the drive transmitting member 30 side) of a side surface of the developer accommodating chamber 18*a*, so that it is possible to suppress that the toner T is localized and agglomerated.

[Another Example of Fixing Method of Elastic Member]

In the above, a fixing method of the elastic member 29 to the stirring member 23 was press-fitting but is not limited thereto if the fixing method is such that the elastic member 29 is not disengaged from the stirring member 23 by impact (shock) during the transportation or the like.

Incidentally, constitutions other than a structure and an assembling method which relate to fixing of the elastic member 29 to the stirring member 23 are similar to the above-described embodiment, and therefore, another example of the fixing method and the assembling method will be described. In this structure, a compression spring is used as the elastic member 29.

Figure 6:
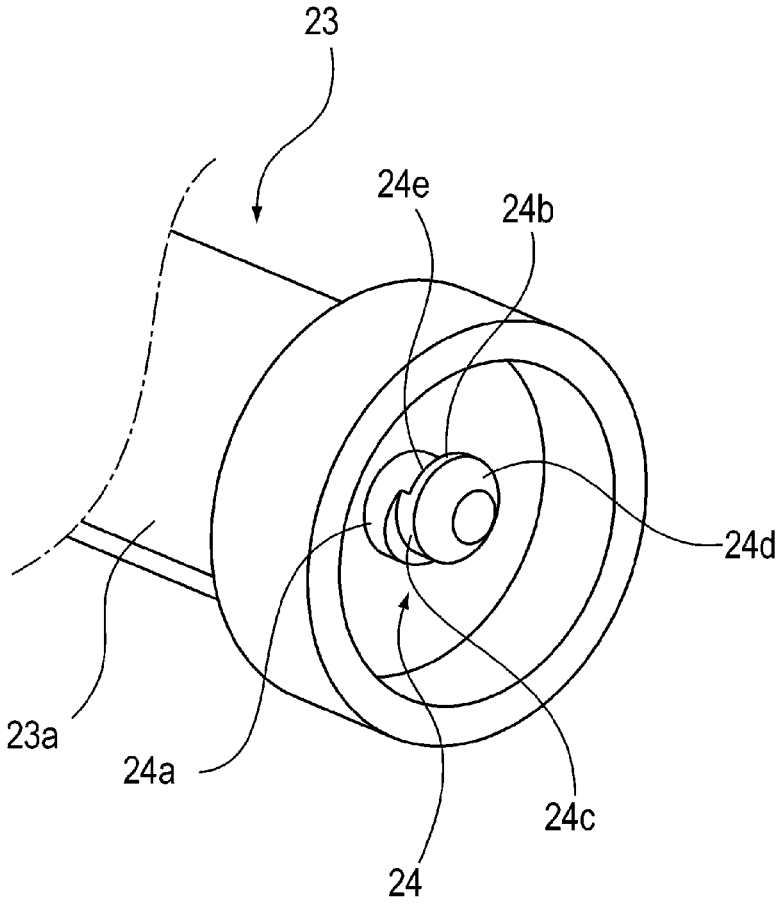
FIG. 6 is a perspective view of an end portion of a stirring member in another example of Embodiment 1.

Using FIG. 6 and part (a) to (d) of FIG. 7, the fixing method of the elastic member (compression spring) 29 to the stirring member 23 will be described. FIG. 6 is a perspective view of one end portion of the stirring member 23. Parts (a) to (d) of FIG. 7 are schematic views showing an assembling method of the stirring member 23, the elastic member 29 and the drive transmitting member 30.

As shown in FIG. 6, at one end portion of the stirring member 23, a fixing portion 24 for fixing the elastic member 29 is provided.

The fixing portion 24 includes an engaging portion to be engaged and fitted with the elastic member 29. The fixing portion 24 further includes a projected portion projecting from the engaging portion 24*a* and a retracted portion 24*c* retracted from the engaging portion 24*a*.

At a surface of the projected portion 24*b* on a free end side, an inclined portion 24*d* for introducing the elastic member 29 during assembling of the elastic member 29. At a surface of the projected portion 24*b* on a base side, a locking portion 24*e* for preventing disengagement of the elastic member 29 by contact with the elastic member 29 when the elastic member 29 is engaged and fitted with the engaging portion 24*a*.

Then, using parts (a) to (d) of FIG. 7, the assembling method when the elastic member (compression spring) 29 is assembled to the fixing portion 24 will be described.

First, as shown in part (a) of FIG. 7, the other end portion of the elastic member 29 is press-fitted around the projected portion 30*a* of the drive transmitting member 30 in advance. The drive transmitting member 30 in a state in which the elastic member 29 is press-fitted around the projected portion 30*a* is inserted in an arrow N direction toward the stirring member 23, so that assembling of the drive transmitting member 30 including the elastic member 29 to the stirring member 23 is carried out.

A state in which the drive transmitting member 30 is somewhat inserted from the state of part (a) of FIG. 7 toward the elastic member 23 is a state of part (b) of FIG. 7. An inner diameter portion of a free end of the elastic member 29 contacts the inclined portion 24*d*, whereby the elastic member 29 is introduced to the projected portion 24*b* side. At this time, the retracted portion 24*c* is retracted in a radial direction of the elastic member 29, and therefore, the elastic member 29 can run up onto the projected portion 24*b* while being inclined.

A state in which the drive transmitting member 30 is further inserted from the state of part (b) of FIG. 7 toward the stirring member 23 is a state of part (c) of FIG. 7. The free end of the elastic member 29 gets over the projected portion 24*b* and starts to engage with the engaging portion 24*a*. In this stage, a part of the elastic member 29 is running up on the projected portion 24*b*.

A state in which the drive transmitting member 30 is further inserted from the state of part (c) of FIG. 7 toward the stirring member 23 is a state of part (d) of FIG. 7. The running-up of the part of the elastic member 29 on the projected portion 24*b* is eliminated, so that a state in which the projected portion 24*b* has entered a portion of a winding (helical) pitch of the elastic member (compression spring) 29 is formed. Simultaneously, engagement of the free end of the elastic member 29 with the engaging portion 24*a* is completed, so that an attitude of the elastic member 29 is determined as a straight state (attitude) by the engaging portion 24*a* and the projected portion 30*a*. As a result, an operation of assembling the elastic member 29 to the fixing portion 24 is completed.

When the elastic member (compression spring) 29 of which assembling is completed moves in a direction of being disengaged from the fixing portion 24, motion of the elastic member 29 is prevented by contact of the locking member 24*e* with the elastic member 29, so that disengagement of the elastic member 29 from the fixing portion 24 is prevented.

As described above, a constitution in which the elastic member 29 is caused to run up onto the projected portion 24*b* by the inclined surface 24*d* during the assembling of the elastic member 29 and is prevented from disengaging from the fixing portion 24 by the locking portion 24*e* when the elastic member 29 is moved in a disengaging direction is employed. As a result, compared with the case where the elastic member is press-fitted with the stirring member, the elastic member can be assembled to the stirring member during assembling, and further, disengagement of the elastic member 29 can be prevented with reliability.

Embodiment 2

Next, a developer accommodating chamber according to Embodiment 2 will be described using FIGS. 8 to 11.

FIG. 8 is a perspective view showing a structure of a stirring member in Embodiment 2. FIG. 9 is a projected view of the stirring member in Embodiment 2. Parts (a), (b) and (c) of FIG. 10 are schematic views for comparing a difference in state between during transportation and during image formation in Embodiment 2. FIG. 11 is a perspective view showing a stirring member in another example of Embodiment 2.

In this embodiment, a portion different from first Embodiment described above will be specifically described. Unless otherwise specified, materials, shapes and the like of constituent elements are the same as those in Embodiment 1. The constituent elements are represented by the same reference numerals or symbols and will be omitted from detailed description.

As shown in FIG. 8, the stirring member 23 includes a flange portion consisting of the rotation shaft 23 as the shaft portion extending in the longitudinal direction of the developer accommodating portion 18*a*, the stirring sheet 23*b* as the stirring portion for stirring the toner T accommodated in the developer accommodating portion 18*a*, and a projection 23*e* projecting outward in a rotation radius direction of the rotation shaft 23*a*. The stirring member 23 is provided in the developer accommodating portion 18*a* so that the rotation shaft 23*a* is rotatable similarly as in the above-described embodiment. The stirring sheet 23*b* is a flexible sheet-shaped member which is mounted to the rotation shaft 23*a* at one end thereof and which feeds and stir the toner. The projection 23*e* is provided at each of end portions of the rotation shaft 23*a* with respect to the axial direction H. The projection 23*e* is formed so as to extend from the rotation shaft 23*a* in a direction of a plane crossing the axial direction H. Specifically, a shape of the projection 23*e* is a disk shape extending in a direction perpendicular to the axial direction H of the rotation shaft 23*a*.

A projected view of the stirring member 23 of FIG. 8 in the axial direction H of the rotation shaft 23*a* is FIG. 9. As shown in FIG. 9, when the stirring member 23 is seen along the axial direction H, the projection 23*e* includes a region S (hatched portion in the figure) which is a non-overlapping portion with the rotation shaft 23*a* and the stirring sheet 23*b*.

[During Transportation]

Next, a state of the process cartridge 7 during transportation will be described using parts (a), (b) and (c) of FIG. 10. Parts (a), (b) and (c) of FIG. 10 are sectional views showing a structure of the developer accommodating portion 18*a*.

As shown in parts (a), (b) and (c) of FIG. 10, a situation in which the process cartridge 7 is transported in a vertically placed state such that an axis (a chain line in the figures) of the rotation shaft 23*a* of the stirring member 23 of the process cartridge 7 extends in the direction of gravitation will be described. Incidentally, for easy understanding of motion of component parts in this situation, herein, only associated component parts consisting of the developer accommodating portion 18*a*, the rotation shaft 23*a*, the elastic member 29 and the drive transmitting member 30 will be illustrated and described. Part (a) of FIG. 10 shows an attitude other than a vertically plated attitude in which the rotational axis direction of the stirring member of the process cartridge is the direction of gravitation.

Part (b) of FIG. 10 shows a state of the developer accommodating portion 18*a* in the case where the process cartridge is transported with the drive transmitting member 30 facing downward with respect to the direction of gravitation.

Similarly as in Embodiment 1, first, vibration is transmitted to the developer accommodating portion 18*a* in the same direction as the axial direction H by the transportation of the process cartridge 7. At this time, the gap L1 between one end portion of the stirring member 23 and the inside surface 18*j* of the developer accommodating portion 18*a* on one end side (the drive transmitting member 30 side) becomes small. At this time, the elastic member 29 is compressed. Thereafter, when the compressed state of the elastic member 29 is restored to the original state, an elastic force acts on the stirring member 23. That is, in the case where the stirring member 23 is moved in a direction in which the first gap L1 becomes small, the elastic member 29 generates an urging force for urging the stirring member 23 in a direction in which the first gap L1 is returned to the original gap. As a result, the stirring member 23 is moved in a direction of being spaced from the inside surface 18*j* of the developer accommodating portion 18*a* on one end side (the drive transmitting member 30 side), so that the gap L1 extends in the direction in which the gap L1 is returned to the original gap. In a period in which the vibration during the transportation continues, the stirring member 23 repeats movement in the direction in which the gap L1 becomes small and movement in the direction in which the gap L1 is returned to the original gap. That is, the stirring member 23 repeats movement (swing) in which the stirring member 23 reciprocates in the axial direction H.

When the stirring member 23 moves in the direction in which the gap L1 becomes small, the toner T deposited on the stirring member 23 and the toner T in the region S move in a direction of approaching the inside surface 18*j* of the developer accommodating portion 18*a* on one end side (the drive transmitting member 30 side).

When the stirring member 23 moves in the direction in which the gap L1 is returned to the original gap, the toner T deposited on the stirring member 23 and the toner T in the region S receive a force in a direction of being spaced from the inside surface 18*j* of the developer accommodating portion 18*a* on one end side (the drive transmitting member 30 side), and move in the direction.

Therefore, the toner T deposited on the stirring member 23 and the toner T in the region S repeat a swing such that the toners T reciprocate in the axial direction H in synchronism with the swing of the stirring member 23. Accordingly, the toner T does not readily gather closely in a direction of the side surface of the developer accommodating portion 18*a* on one end side (the drive transmitting member 30 side), so that it is possible to suppress that the toner T is localized and agglomerated.

In this case, in this embodiment, by providing the projection 23*e*, not only the toner T deposited on the stirring member 23 but also the toner in the region S can be swung.

Accordingly, the toner T does not gather closely when compared with the case of Embodiment 1, so that agglomeration of the toner T due to localization can be suppressed.

Part (c) of FIG. 10 shows a state of the developer accommodating portion 18*a* in the case where the process cartridge is transported with the drive transmitting member 30 facing upward with respect to the direction of gravitation.

Also in this case, similarly as in Embodiment 1, vibration in the same direction as the axial direction H is transmitted to the developer accommodating portion 18*a* by the transportation of the process cartridge 7. At this time, the gap L2 between one end portion of the stirring member 23 and the inside surface 18*k* of the developer accommodating portion 18*a* on the other side (side opposite from the drive transmitting member 30 side) becomes small. At this time, the elastic member 29 is stretched. Thereafter, when the stretched state of the elastic member 29 is restored to the original state, an elastic force acts on the stirring member 23. That is, in the case where the stirring member 23 is moved in a direction in which the second gap L2 becomes small, the elastic member 29 generates an urging force for urging the stirring member 23 in a direction in which the second gap L2 becomes large (i.e., is returned to the original gap). As a result, the stirring member 23 is moved in a direction of being spaced from the inside surface 18*j* of the developer accommodating portion 18*a* on the other end side (side opposite from the drive transmitting member 30 side), so that the gap L2 extends in the direction in which the gap L2 is returned to the original gap. In a period in which the vibration during the transportation continues, the stirring member 23 repeats movement in the direction in which the gap L2 becomes small and movement in the direction in which the gap L2 is returned to the original gap. That is, the stirring member 23 repeats movement (swing) in which the stirring member 23 reciprocates in the axial direction H.

When the stirring member 23 moves in the direction in which the gap L2 becomes small, the toner T deposited on the stirring member 23 and the toner T in the region S move in a direction of approaching the inside surface 18*k* of the developer accommodating portion 18*a* on the other end side (side opposite from the drive transmitting member 30 side).

When the stirring member 23 moves in the direction in which the gap L2 is returned to the original gap, the toner T deposited on the stirring member 23 and the toner T in the region S receive a force in a direction of being spaced from the inside surface 18*k* of the developer accommodating portion 18*a* on the other end side (side opposite from the drive transmitting member 30 side), and move in the direction.

Therefore, the toner T deposited on the stirring member 23 and the toner T in the region S repeat a swing such that the toners T reciprocate in the axial direction H in synchronism with the swing of the stirring member 23. Accordingly, the toner T does not readily gather closely in a direction of the side surface of the developer accommodating portion 18*a* on the other end side (side opposite from the drive transmitting member 30 side), so that it is possible to suppress that the toner T is localized and agglomerated.

In this case, in this embodiment, by providing the projection 23*e*, not only the toner T deposited on the stirring member 23 but also the toner in the region S can be swung. Accordingly, the toner T does not gather closely when compared with the case of Embodiment 1, so that agglomeration of the toner T due to localization can be suppressed.

As described above, by providing the projection 23*e*, it is possible to increase an amount of the toner T which can be swung during the transportation of the process cartridge 7. As a result, compared with the case of Embodiment 1, it is possible to effectively suppress that the toner T is localized and agglomerated.

In this embodiment, the shape of the projection 23*e* was the disk shape provided at each of the end portions of the stirring member 23 with respect to the axial direction H, but the present invention is not limited thereto. In FIG. 9, when at least the region S can be ensured, the number, arrangement and shape of the projection 23*e* may only be required to be appropriately set as needed.

For example, as shown in FIG. 11, a constitution in which at a central portion of a stirring member 23 with respect to the longitudinal direction (axial direction H), a boss 23*f* as the projection is provided may also be employed. Also in this constitution, it is possible to suppress the agglomeration of the toner T due to localization more effectively than the case of Embodiment 1.

Other Embodiment

In the above-described embodiments, the developing unit constituting a part of the process cartridge was exemplified as the developer accommodating chamber which is mounted in the image forming apparatus and which receives the driving force from the image forming apparatus, but the developer accommodating chamber is not limited thereto. For example, the developer accommodating chamber may also be other developer accommodating chambers, such as a toner unit including the developer accommodating portion and the stirring member, and a developing device including the developer carrying member, the developer accommodating portion and the stirring member. By applying the present invention to these developer accommodating chambers, a similar effect can be achieved.

In the above-described embodiments, as the elastic member, the compression spring was exemplified, but the elastic member is not limited thereto. The elastic member may also be an elastic member other than the compression spring when the elastic member is expandable and contractable in the longitudinal direction of the developer accommodating portion and imparts an elastic force to the stirring member.

In the above-described embodiments, the four image forming portions were used, but the number of image forming portions used is not limited. The number of the image forming portions may only be required to be appropriately set as needed.

In the above-described embodiments, as the exposure means, the scanner unit (laser scanner) was used, but the exposure means is not limited thereto. For example, an LED array or the like may also be used.

In the above-described embodiments, as the process cartridge mountable in and dismountable from the apparatus main assembly of the image forming apparatus, the process cartridge integrally including the photosensitive drum, and as process means actable on the photosensitive drum, the charging means, the developing means and the cleaning means was exemplified. However, the process cartridge is not limited thereto. The process cartridge may also be a process cartridge integrally including, in addition to the photosensitive drum, either one of the charging means, the developing means and the cleaning means.

In the above-described embodiments, as the image forming apparatus, the printer was exemplified, but the present invention is not limited thereto. For example, the image forming apparatus may also be other image forming apparatuses such as a copying machine, a facsimile machine and a multi-function machine having functions of these machines in combination. Further, the image forming apparatus in which the intermediary transfer member is used and the toner image is transferred from the intermediary transfer member onto the recording material was exemplified, but the present invention is not limited thereto. For example, an image forming apparatus in which a recording material carrying member is used and the toner image is transferred onto the recording material carried on the recording material carrying member may also be used. A similar effect can be achieved by applying the present invention to developer accommodating chambers used in these image forming apparatuses.

According to the present invention, agglomeration of the developer occurring during the transportation of the process cartridge can be effectively suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-066567 filed on Mar. 30, 2018, which is hereby incorporated by reference herein in its entirety.

What is claimed is:

1. A developer accommodating container comprising:

a developer accommodating portion configured to accommodate a developer;

a stirring member rotatably provided in said developer accommodating portion and configured to stir the developer accommodated in said developer accommodating portion, said stirring member extending in a longitudinal direction of said developer accommodating portion; and a drive transmitting member configured to transmit a rotational driving force to said stirring member, wherein said developer accommodating container further comprises an elastic member, which is fixed to said stirring member at one end portion of the elastic member and to said drive transmitting member at the other end portion of the elastic member, and which is capable of expanding and contracting in a direction along a longitudinal direction of said developer accommodating portion, wherein said stirring member is disposed so as to form (1) a first gap between one end portion of the stirring member and an inner surface of said developer accommodating portion on one side with respect to the longitudinal direction and (2) a second gap between the other end portion of the stirring member and another inner surface of said developer accommodating portion on the other side with respect to the longitudinal direction in order to allow said stirring member to be movable in the longitudinal direction relative to said developer accommodating portion after said stirring member is installed in said developer accommodating portion with said elastic member, and wherein said one end portion of the stirring member is provided with a cylindrical portion formed to cover said elastic member from the outside.

2. The developer accommodating container according to claim 1, wherein said elastic member is constituted so that an urging force for urging said stirring member in a direction in which one of the first gap and the second gap is returned to an original gap is generated when said stirring member is moved in a direction in which said one of the first gap and the second gap decreases.

3. The developer accommodating container according to claim 1, wherein said elastic member is a compression spring capable of expanding and contracting in the longitudinal direction.

4. The developer accommodating container according to claim 1, wherein said stirring member includes: a shaft portion rotatably provided in said developer accommodating portion and extending in the longitudinal direction of said developer accommodating portion, and a stirring portion mounted on said shaft portion, and wherein said elastic member is disposed between said shaft portion and said drive transmitting member with respect to an axial direction of said shaft portion.

5. The developer accommodating container according to claim 4, wherein said stirring member further comprises a flange portion projecting toward an outside of said shaft portion with respect to a radial direction of rotation of said shaft portion, and wherein when said stirring member is seen along the axial direction of said shaft portion of the stirring member, said flange portion includes a non-overlapping region with said shaft portion and said stirring portion.

6. The developer accommodating container according to claim 5, wherein said flange portion is provided at each of end portions of said shaft portion of said stirring member with respect to the axial direction of said shaft portion.

7. The developer accommodating container according to claim 5, wherein said flange portion is formed so as to extend from said shaft portion in a direction included in a plane crossing the axial direction of said shaft portion.

8. The developer accommodating container according to claim 7, wherein said flange portion has a disk shape.

9. A developing device comprising:

a developer accommodating container; and a developer carrying member provided in said developer accommodating container and configured to carry a developer, wherein said developing device is attachable to and detachable from a main assembly of an image forming apparatus, and wherein said developer accommodating container includes:

a developer accommodating portion configured to accommodate the developer;

a stirring member rotatably provided in said developer accommodating portion and configured to stir the developer accommodated in said developer accommodating portion, said stirring member extending in a longitudinal direction of said developer accommodating portion; and a drive transmitting member configured to transmit a rotational driving force to said stirring member, wherein said developer accommodating container further comprises an elastic member, which is fixed to said stirring member at one end portion of the elastic member and to said drive transmitting member at the other end portion of the elastic member, and which is capable of expanding and contracting in a direction along a longitudinal direction of said developer accommodating portion, wherein said stirring member is disposed so as to form (1) a first gap between one end portion of the stirring member and an inner surface of said developer accommodating portion on one side with respect to the longitudinal direction and (2) a second gap between the other end portion of the stirring member and another inner surface of said developer accommodating portion on the other side with respect to the longitudinal direction in order to allow said stirring member to be movable in the longitudinal direction relative to said developer accommodating portion after said stirring member is installed in said developer accommodating portion with said elastic member, and wherein said one end portion of the stirring member is provided with a cylindrical portion formed to cover said elastic member from the outside.

10. A process cartridge attachable to and detachable from an image forming apparatus, said process cartridge comprising:

a developer accommodating container;

a developer carrying member provided in said developer accommodating container and configured to carry a developer; and an image bearing member configured to bear a developer image, wherein said developer accommodating container includes:

a developer accommodating portion configured to accommodate the developer;

a stirring member rotatably provided in said developer accommodating portion and configured to stir the developer accommodated in said developer accommodating portion, said stirring member extending in a longitudinal direction of said developer accommodating portion; and a drive transmitting member configured to transmit a rotational driving force to said stirring member, wherein said developer accommodating container further comprises an elastic member, which is fixed to said stirring member at one end portion of the elastic member and to said drive transmitting member at the other end portion of the elastic member, and which is capable of expanding and contracting in a direction along a longitudinal direction of said developer accommodating portion, wherein said stirring member is disposed so as to form (1) a first gap between one end portion of the stirring member and an inner surface of said developer accommodating portion on one side with respect to the longitudinal direction and (2) a second gap between the other end portion of the stirring member and another inner surface of said developer accommodating portion on the other side with respect to the longitudinal direction in order to allow said stirring member to be movable in the longitudinal direction relative to said developer accommodating portion after said stirring member is installed in said developer accommodating portion with said elastic member, and wherein said one end portion of the stirring member is provided with a cylindrical portion formed to cover said elastic member from the outside.

* * * * *